US006409327B1

(12) United States Patent
Koeleman et al.

(10) Patent No.: US 6,409,327 B1
(45) Date of Patent: Jun. 25, 2002

(54) INK JET DEVICE WITH A DISPENSER FOR INK PELLETS

(75) Inventors: Gerardus A. J. Koeleman, Velden; Jerry Josephus A. C. Roctus, Clinge; Marc Paul Schuwer, Eindhoven, all of (NL)

(73) Assignee: Oce Technologies B.V., MA Venlo (NL)

( * ) Notice: Subject to any disclaimer, the term of this patent is extended or adjusted under 35 U.S.C. 154(b) by 0 days.

(21) Appl. No.: 09/711,296

(22) Filed: Nov. 14, 2000

(30) Foreign Application Priority Data

Nov. 15, 1999 (EP) ..... 99203808

(51) Int. Cl.[7] ..... B41J 2/175
(52) U.S. Cl. ..... 347/88; 347/85
(58) Field of Search ..... 347/85, 86, 87, 347/88

(56) References Cited

U.S. PATENT DOCUMENTS 4,723,135 A * 2/1988 Yano et al. ..... 347/88
5,621,444 A 4/1997 Beeson ..... 347/88
5,633,667 A * 5/1997 Miyazawa ..... 347/86

FOREIGN PATENT DOCUMENTS

EP 0178882 4/1986
EP 0338590 10/1989
EP 0827835 3/1998

OTHER PUBLICATIONS

Yoshinori, M., English abstract of Japanese patent 02–113951, Apr. 26, 1990.
Masataka, O., English abstract of Japanese patent 60–135260, Jul. 18, 1985.
"Ink jet device with ink resevoir", *Research Disclosure*, Mar. 1999, pp. 374–375.

* cited by examiner

*Primary Examiner*—Anh T. N. Vo
(74) *Attorney, Agent, or Firm*—Birch, Stewart, Kolasch & Birch, LLP

(57) ABSTRACT

An ink dispensing device for selectively dispensing ink pellets into an ink reservoir which comprises casing and a slide, said casing and said slide defining therebetween a first sluice and a second sluice, each of which is adapted to accommodate at least one ink pellet, and means for moving the slide and/or the casing relative to each other whereby a pellet is discharged from the first sluice into the second sluice and simultaneously a pellet is discharged from the second sluice into the ink reservoir.

9 Claims, 2 Drawing Sheets

INK JET DEVICE WITH A DISPENSER FOR INK PELLETS

BACKGROUND OF THE INVENTION

The present invention relates to an ink jet device comprising an ink reservoir and a dispenser for ink pellets, wherein the dispenser comprises a sluice for discharging the pellets one by one into the ink reservoir.

In an ink jet device, such as an ink jet printer, an ink reservoir is incorporated in the printhead or in a separate cartridge and serves to accommodate a certain amount of liquid ink which is to be supplied to a nozzle system of the printhead. In case of a hot melt ink jet device the ink reservoir is heated in order to keep the temperature of the ink above its melting point, e.g., at a temperature of about 100° C. or more. Research Disclosure Bulletin, March 1999, No. 41973, pages 374 to 376 discloses an ink jet device in which hot melt ink can be supplied in pellet or tablet form. The dispenser used for supplying the ink tablets one by one into the ink reservoir of the printhead may be mounted on the same carriage as the printhead so as to travel back and forth along the printing medium. Alternatively, the dispenser or at least an actuating mechanism thereof may be disposed stationarily above one of the end positions of the carriage, so that an ink tablet can be supplied into the reservoir each time the carriage has performed a complete stroke and stops in the end position.

The supply of ink in tablet form has the advantage that the amount of ink to be melted in the ink reservoir can be metered with high precision and, accordingly, the temperature of the molten ink within the ink reservoir can be kept stable.

The dispenser of known ink jet devices has a simple sluice mechanism of the type generally known in dispensers of candy. Such sluice mechanisms are, however, not fully reliable, and it may happen that the dispenser, although it has been actuated, fails to discharge a tablet. This may give rise to a shortage of ink, in particular in the case where the dispenser can be actuated only after each stroke of the carriage.

SUMMARY OF THE INVENTION

It is accordingly an object of the present invention to provide an ink jet device in which ink tablets can be supplied more reliably.

In order to achieve this object, there is provided an ink jet device wherein the dispenser comprises an output chamber for accommodating a single pellet discharged from the sluice, and a shutter for opening and closing the output chamber towards the ink reservoir.

According to the present invention, the pellet or tablet which needs to be timely supplied to the ink reservoir is held readily available in the output chamber and can reliably be transferred into the ink reservoir, simply by opening the shutter. Simultaneously or at a later instant, the sluice mechanism is actuated in order to supply another single pellet to the output chamber. If the sluice mechanism fails, it can be actuated repeatedly until a pellet is discharged into the output chamber, so that the next pellet will be reliably available when it is needed.

As is generally known, the dispenser comprises a storage chamber for accommodating a number of tablets and a slide movably disposed in said chamber and forming the sluice mechanism together with a portion of a bottom wall of the storage chamber. Preferably, the output chamber is also formed by a portion of the bottom wall of the storage chamber and a portion of the slide, and the shutter is also formed by a portion of the slide of the sluice mechanism, so that the shutter and the sluice mechanism can be easily actuated in a single operation. More specifically, the shutter and the output chamber may form a second sluice which has essentially the same construction as the first sluice. The reason why the sluice mechanism is not fully reliable is mainly due to the fact that a plurality of tablets present in a supply passage above the sluice tend to become clogged in the supply passage. Since the second sluice will not receive more than a single tablet at a time, a reliable and fail-safe function of the second sluice is assured.

In a preferred embodiment, a sensor, e.g., an optical sensor, is provided for detecting the presence or absence of a tablet in the output chamber, and when no tablet is detected after the sluice mechanism has been actuated, a signal is generated for actuating the sluice mechanism once again.

BRIEF DESCRIPTION OF THE DRAWINGS

A preferred embodiment of the invention will now be described in conjunction with the accompanying drawings, in which.

DETAILED DESCRIPTION OF THE INVENTION

Figure 1:
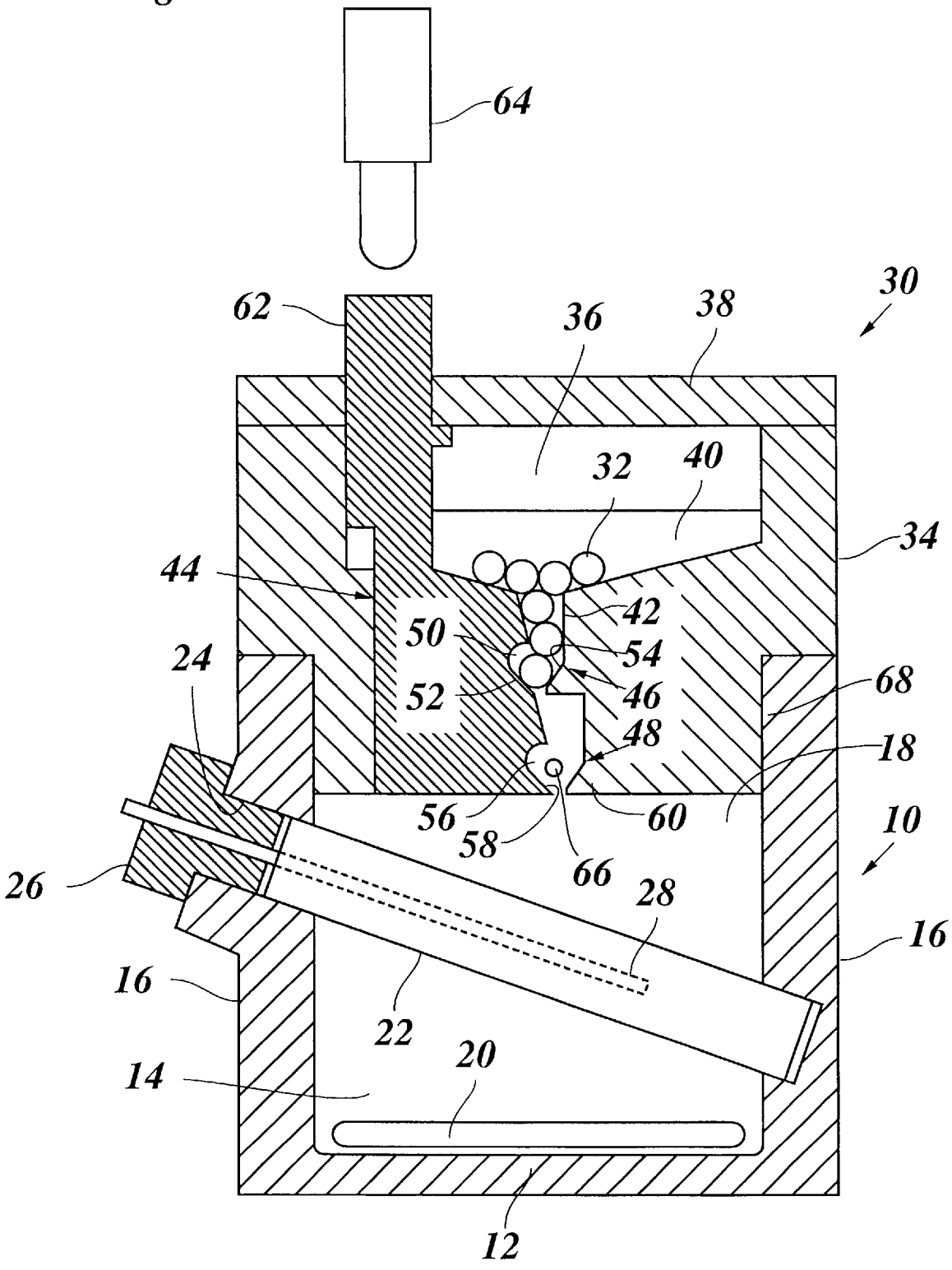
FIG. 1 is a longitudinal section of an ink reservoir and an ink dispenser of an ink jet device.

An ink reservoir 10 in an ink cartridge or a printhead of a hot melt ink jet printer is formed by a casing having a bottom wall 12, two parallel longer side walls 14 and two parallel shorter side walls 16. In the top part of the ink reservoir, the side walls 14,16 define an inlet port 18 which has an elongated rectangular cross-section when viewed from above. Outlet ports 20, through which the ink is supplied to a nozzle system (not shown) of the printhead, are formed as elongate slots in the side walls 14 close to the bottom wall 12.

The inlet port 18 is separated from the lower portion of the ink reservoir including the outlet ports 20 by a tubular filter element 22 which can also be flat. The filter element is inserted into the ink reservoir through an opening 24 formed in one of the side walls 16 and closed by a plug 26. In the shown embodiment, a rod-like sensor element 28 is embedded in the plug 26 and extends coaxially in the tubular filter element. This sensor element 28 may, for example, serve as a level detector for detecting the level of the ink liquid in the ink reservoir and/or as a temperature sensor for monitoring the temperature of the hot-melt ink.

The ink reservoir 10 is heated, and the ink is supplied in a solid state in the form of small pellets or tablets which are so sized that the supply of a single tablet which then has to be melted in the ink reservoir will not cause a significant change in the temperature of the liquid ink.

Figure 2:
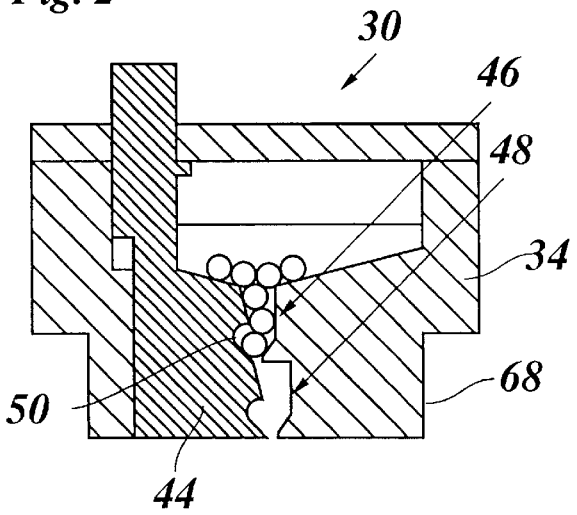
FIGS. 2 to 6 are sectional views of the ink dispenser in different operating states.

FIGS. 1 and 2 further show an ink dispenser 30 which is used for supplying ink tablets 32 into the ink reservoir. In the shown embodiment the ink tablets 32 have a flat cylindrical shape. The dispenser 30 has a casing 34 defining a storage chamber 36 that is sealingly closed by a cover 38. The lower portion of the storage chamber 36 which can accommodate a large number of tablets 32 is formed as a narrow funnel 40, the width of which (in the direction normal to the plane of the drawing) is only slightly larger than the thickness of the tablets, so that the tablets are oriented as is shown in the drawing.

The bottom of the funnel 40 is formed by inclined walls which converge downwardly towards a narrow passage 42 the width of which is only slightly larger than the diameter of the tablets 32 and still slightly decreases towards the bottom end, so that only one tablet can pass through the passage 42 at a time. One of the inclined walls of the bottom of the funnel 40 and one wall of the passage 42 are formed by the casing 34, whereas the other of the inclined walls of the funnel and the adjacent wall of the passage 42 are formed by a slide 44 which is guided in the casing 34 and the cover 38 and is slidingly movable in the vertical direction. The slide 44 is biased upwardly by a pressing member such as a spring (not shown) so that it is normally held in the position shown in FIGS. 1 and 2.

At the lower end of the passage 42 the slide 44 and the casing 34 form a first sluice 46 and a second sluice 48.

The first sluice 46 comprises a cavity 50 formed in the slide 44 and shaped to accommodate a single tablet. The lower wall of the cavity 50 merges into a downwardly inclined ramp surface 52. When the slide 44 is in the position shown in FIG. 1, the ramp surface 52 and another ramp surface 54 on the opposing side of the passage 42 converge and hold the lower end of the first sluice 46 closed.

The second sluice 48 has essentially the same configuration as the first sluice and, accordingly, comprises another cavity formed in the slide 44 and shaped to accommodate a single tablet. This cavity serves as an output chamber 56 for the dispenser. The lower wall of the output chamber 56 merges into a downwardly inclined ramp surface 58. When the slide 44 is in the position shown in FIGS. 1 and 2, the ramp surface 58 and the other ramp surface formed by the nose 60 of the casing 34 converge and hold the lower end of the second sluice 48 in a closed position. Thus, the ramp surface 58 and the nose 60 cooperate to form a shutter for opening and shutting the second sluice 48.

The top portion of the slide 44 projects through the cover 38 and forms a push button 62 which can be depressed by means of an actuator 64.

The output chamber 56 has an optical sensor 66 or at least a transparent window for an optical sensor which detects the presence or absence of a tablet 32 in the output chamber and delivers a detection signal to a control system for the actuator 64. Also a mechanical switch could be used.

The bottom wall of the casing 34 forms a projection 68 which fits into the open end of the ink reservoir 10, as is shown in FIG. 1. When the dispenser 30 is disposed on the ink reservoir 10 in this manner and the push button 62 is depressed, the slide 44 moves downward, as is shown in FIGS. 3 and 4.

Figure 3:
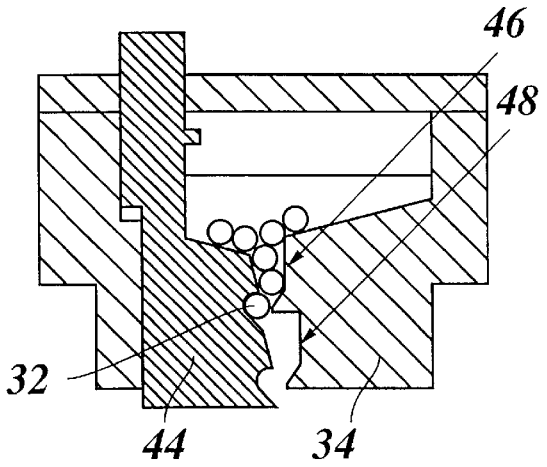

FIG. 3 shows that the lowermost one of the tablets 32 is deflected by the ramp surface 54 so that it is accommodated in the cavity 50 and can move downward into the second sluice 48.

Figure 4:
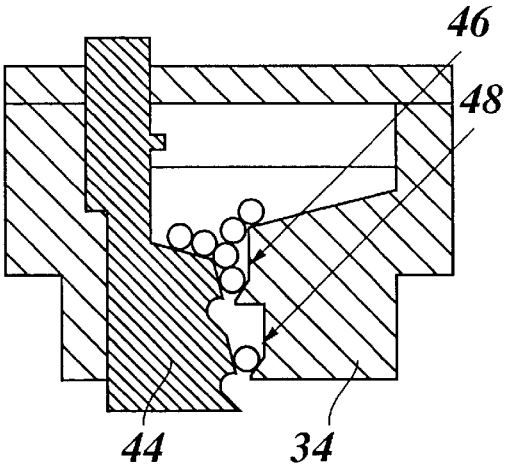

FIG. 4 shows the slide 44 in its lower extreme position. In this state, the ramp surfaces 52 and 54 are vertically offset from one another so that the tablet 32 that has previously been accommodated in the cavity 50 is now dropped into the second sluice via the ramp surface 52. At the same time, the tapering walls of the passage 42 prevent the next tablet from entering into the cavity 50. Thus, it is assured that only a single tablet is supplied to the second sluice 48. This tablet is at first caught by the nose 60 in a position above the output chamber 56, as is shown in FIG. 4.

Figure 5:
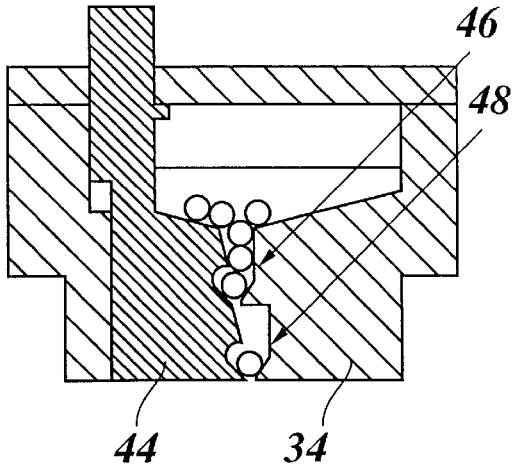

When the push button 62 is released again, the spring-biased slide 44 moves upward, and when it reaches the position shown in FIG. 5, the next tablet enters into the cavity 50 so that the dispenser is ready for a subsequent supply operation. At the same time the tablet that has dropped into the second sluice 48 is accommodated in the output chamber 56.

The tablet in the output chamber 56 is supported on the one hand by the ramp surface 58 of the slide 44 and on the other hand by the ramp surface of the nose 60 and is held in a position in front of the optical sensor 66.

Once the slide 44 has been actuated in the manner described above, the sensor 66 should indicate the presence of a tablet 32 in the output chamber 56. When however, the first sluice 46 has failed to supply a tablet, this is also indicated by the sensor 66, and the actuator 64 is operated once again in order to make another attempt to supply a tablet into the second sluice 48. This attempt may be repeated as often as required.

Figure 6:
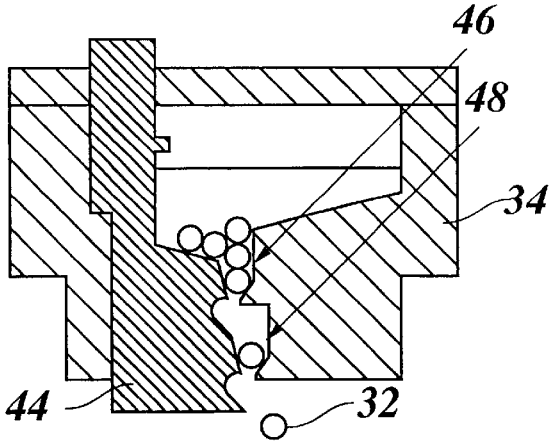

The state illustrated in FIG. 5 corresponds to the normal operating state of the dispenser. In this state, one tablet is accommodated in the output chamber 56 of the second sluice 48 and another tablet is present in the cavity 50 of the first sluice 46. When it is detected, for example by means of the sensor element 28, that another tablet needs to be supplied into the ink reservoir 10, the slide 44 is depressed once again, as is shown in FIG. 6. Then the tablet 32 which has been in a stand-by position in the second sluice 48 is reliably released into the inlet port 18 of the ink reservoir 10, and simultaneously the next tablet is transferred from the first sluice 46 to the second sluice 48. This cycle is repeated whenever there is demand for another ink tablet. Should the first sluice 46 fail to supply a tablet into the second sluice 48, the actuator 64 will cause the slide 44 to perform one or more extra strokes in response to the signal supplied from the sensor 66.

The dispenser 30 and the actuator 64 may be permanently mounted on the ink reservoir 10 when the ink jet device is operating. In the shown embodiment, however, the dispenser 30 is removably disposed on the ink reservoir 10. The dispenser can be manufactured at low costs from cheap recycling materials such as recycled plastic material and may form a disposable refill package in which the ink tablets are delivered to the user. The dispenser mostly forms part of the ink reservoir and moves together with the ink jet head on the carriage. However, it is also possible to fix this dispenser at the frame of the print-engine, thereby minimizing the weight of the carriage.

The actuator 64 is preferably held at a machine frame (not shown) of the printer, so that it need not be removed when the refill package is replaced. In this case, the actuator is ready to depress the push button 62 only when the carriage on which the ink reservoir 10 and the dispenser 30 are mounted stops in a predetermined position, e.g. at one end of the carriage stroke. The amount of ink contained in a single tablet 32 will be sufficient for a plurality of carriage strokes, so that the actuator will normally be operated only every second, third, or n-th stroke of the carriage. Only when the sensor 66 detects that the output chamber 56 is empty will the actuator 64 be operated again after the next stroke of the carriage. It is also possible to hold the separation unit at the machine frame. In this case only a cassette holding the pills or pellets or tablets has to be replaced.

Similarly, the sensor 66 can be disposed stationarily at the frame of the printer in a position which corresponds to the position of the transparent window of the output chamber 56 when the carriage stops in the position in which the push button 62 is aligned with the actuator 64.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink dispensing device for selectively dispensing ink pellets into an ink reservoir which comprises:

a casing and a slide, said casing and said slide defining therebetween a first sluice and a second sluice, each of which is adapted to accommodate at least one ink pellet, said first sluice and said second sluice having similar configurations which contain output chambers terminating in downwardly inclined ramp surfaces, and means for moving the slide and the casing relative to each other whereby the pellet is discharged from the first sluice into the second sluice and simultaneously the pellet is discharged from the second sluice into the ink reservoir.

2. The ink dispensing device of claim 1, wherein the slide moves relative to the casing and actuator means is provided to move the slide.

3. The ink dispensing device of claim 2, wherein a sensor is disposed in an output chamber of the second sluice for detecting the presence of an ink tablet in said output chamber.

4. The ink dispensing device of claim 1, wherein the first sluice is adapted to accommodate a plurality of said pellets for feeding said pellets one-by-one to the second sluice.

5. The ink dispensing device of claim 1, wherein the casing further defines a storage chamber which communicates with the first sluice, said storage chamber being adapted to contain a plurality of said ink pellets.

6. The ink dispensing device of claim 1, removably disposed on top of an ink reservoir.

7. An ink jet printing device containing an ink reservoir and an ink dispensing device operatively associated with the ink reservoir, said ink dispensing device comprising a casing and a slide, said casing and sail slide defining therebetween a first sluice and a second sluice, each of which is adapted to accommodate at least one ink pellet, said first sluice and said second sluice having similar configurations which contain output chambers terminating in downwardly inclined ramp surfaces, and means for moving the slide and the casing relative to each other whereby the pellet is discharged from the first sluice into the second sluice and simultaneously the pellet is discharged from the second sluice into the ink reservoir.

8. A method of dispensing ink from an ink dispensing device to an ink reservoir of an ink jet printer, said ink dispensing device having a casing and a slide, said casing and said slide defining therebetween a first sluice and a second sluice, said method comprising introducing ink pellets into a storage chamber which communicates with the first sluice, moving said slide relative to said casing causing the ink pellets to be dispensed, one-by-one, from the storage chamber through the first sluice and through the second sluice into the ink reservoir, wherein a sensing means is disposed in the second sluice for sensing the absence of ink pellets in the second sluice causing the movement of the slide relative to the casing which dispenses the ink pellets from the first sluice into the second sluice.

9. An ink dispensing device for selectively dispensing ink pellets into an ink reservoir which comprises a casing and a slide, said casing and said slide defining therebetween a first sluice and a second sluice, each of which is adapted to accommodate at least one ink pellet, an actuator for moving the slide relative to the casing whereby the pellet is discharged from the first sluice into the second sluice and simultaneously the pellet is discharged from the second sluice into the ink reservoir, and a sensor disposed in an output chamber of the second sluice for detecting the presence of an ink tablet in said output chamber, wherein the actuator is operated in response to a signal received from the sensor indicating the presence or absence of an ink tablet in said output chamber.

* * * * *